United States Patent [19]

Debevec

[11] Patent Number: 4,690,108

[45] Date of Patent: Sep. 1, 1987

[54] FUEL/OIL PUMP

[76] Inventor: Anthony F. Debevec, 38518 Waveland, Waukegan, Ill. 60087

[21] Appl. No.: 760,890

[22] Filed: Jul. 31, 1985

[51] Int. Cl.[4] ..... F02B 33/04

[52] U.S. Cl. ..... 123/73 AD; 123/196 S; 123/198 D

[58] Field of Search ..... 123/73 AD, 196 S, 198 D, 123/73 R; 417/25, 38, 63, 388

[56] References Cited

U.S. PATENT DOCUMENTS

| | | | |
|---|---|---|---|
| 1,038,803 | 9/1912 | Vaughan | 340/611 |
| 1,309,362 | 7/1919 | Lehmann | 200/82 C |
| 1,573,371 | 2/1926 | Bloch | 340/611 |
| 1,582,154 | 4/1926 | Zeiher et al. | 340/611 |
| 2,112,664 | 3/1938 | Dube | 123/196 S |
| 2,529,688 | 11/1950 | Grupp | 219/29 S |
| 2,747,042 | 5/1956 | Zimmerman | 200/81.9 R |
| 2,772,409 | 11/1956 | Reid | 340/611 |
| 2,792,912 | 5/1957 | Kangas | 123/196 S |
| 2,826,754 | 3/1958 | Carignan | 340/608 |
| 3,050,003 | 8/1962 | Edwards | 417/12 |
| 3,057,977 | 10/1962 | Caswell | 200/81.9 M |
| 3,416,560 | 12/1968 | Bruno | 137/456 |
| 3,551,620 | 12/1970 | Hoover | 200/83 L |
| 3,846,774 | 11/1974 | Thorbard et al. | 340/611 |
| 4,101,874 | 7/1978 | Denison et al. | 340/606 |
| 4,146,885 | 3/1979 | Lawson, Jr. | 340/573 |
| 4,166,936 | 9/1979 | Tice | 200/82 E |
| 4,181,835 | 1/1980 | Stadler et al. | 200/82 E |
| 4,313,111 | 1/1982 | Anderson | 340/606 |
| 4,369,743 | 1/1983 | Holt et al. | 123/196 S |
| 4,381,741 | 5/1983 | Walsworth | 123/73 AD |
| 4,383,504 | 5/1983 | Walsworth | 123/73 AD |
| 4,473,340 | 9/1984 | Walsworth | 417/274 |
| 4,475,407 | 10/1984 | Kruncos | 73/861.53 |
| 4,539,949 | 9/1985 | Walsworth | 123/73 AD |
| 4,562,801 | 1/1986 | Kolke | 123/196 S |

FOREIGN PATENT DOCUMENTS 0037296 10/1981 European Pat. Off. .

*Primary Examiner*—Craig R. Feinberg
*Assistant Examiner*—David A. Okonsky

[57] ABSTRACT

A pump comprising a housing, an oil pumping chamber in the housing, an oil passageway in the housing communicating with the oil pumping chamber, an oil pumping piston reciprocally movable in the oil pumping chamber to produce oil flow into the oil passageway in response to reciprocation of the oil pumping piston, a switch mounted on the housing and adapted to be operably connected to a device for actuation thereof, and a mechanism for closing the switch in response to oil flow in the oil passageway.

35 Claims, 3 Drawing Figures

FUEL/OIL PUMP

BACKGROUND OF THE INVENTION

The invention relates to oil pumps, and more particularly to combined fuel and oil pumps used in connection with two-cycle internal combustion engines.

Attention is directed to the following U.S. patents:

| Inventor | U.S. Pat. No. | Granted |
|---|---|---|
| Vaughan | 1,038,803 | Sept. 17, 1912 |
| Lehmann | 1,309,362 | July 8, 1919 |
| Bloch | 1,573,371 | Feb. 16, 1926 |
| Zeiher, et al. | 1,582,154 | April 27, 1926 |
| Grupp | 2,529,688 | Nov. 14, 1950 |
| Zimmerman | 2,747,042 | May 22, 1956 |
| Reid | 2,772,409 | Nov. 27, 1956 |
| Carignan | 2,826,754 | March 11, 1958 |
| Edwards | 3,050,003 | Aug. 21, 1962 |
| Caswell | 3,057,977 | Oct. 9, 1962 |
| Bruno | 3,416,560 | Dec. 17, 1968 |
| Hoover | 3,551,620 | Dec. 29, 1970 |
| Thorbard, et al. | 3,846,774 | Nov. 5, 1974 |
| Denison, et al. | 4,101,874 | July 18, 1978 |
| Anderson | 4,313,111 | Jan. 26, 1982 |
| Holt, et al | 4,369,743 | Jan. 25, 1983 |
| Lawson | 4,146,885 | Mar. 27, 1979 |
| Tice | 4,166,936 | Sept. 4, 1979 |
| Stadler | 4,181,835 | Jan. 1, 1980 |

Attention is also directed to the following U.S. patent applications which disclose fuel and oil pumps: Walsworth U.S. Ser. No. 410,497, filed Aug. 23, 1982 and now U.S. 4,539,949 and titled "Combined Fluid Pressure Actuated Fuel and Oil Pump;" and Baars U.S. Ser No. 700,550, filed Feb. 11, 1985 and now U.S. Pat. No. 4,594,970 and titled "Marine Installation Including Fuel/Oil Mixing Device."

SUMMARY OF THE INVENTION

The invention provides a pump comprising a housing, an oil pumping chamber in the housing, an oil outlet passageway in the housing communicating with said oil pumping chamber, an oil pumping piston reciprocally movable in the oil pumping chamber to produce oil flow into the oil passageway in response to reciprocation of the oil pumping piston, a switch mounted on the housing and adapted to be operably connected to a device for actuation thereof, a second piston reciprocally movable in the housing, relative to the oil outlet passageway between spaced first and second positions, means for closing the switch in response to movement of the second piston to the first position, and means biasing the second piston to the second position.

In one embodiment, the second piston moves to the first position in response to an oil pulse in the oil outlet passageway, movement of the second piston to the first position opens the oil outlet passageway, and movement of the second piston to the second position closes the oil outlet passageway.

In one embodiment, the means for closing the switch in response to movement of the second piston includes a rocker arm having opposite first and second ends and being pivotally mounted in the housing for movement about a pivot point intermediate the opposite ends, the first end being engageable with the second piston for movement in one direction in response to movement of the second piston to the first position, and the second end being engageable with the switch for closing the switch in response to movement of the first end in the one direction.

In one embodiment, the switch includes an outwardly biased plunger movable inwardly to close the switch, the second end of the rocker arm is engageable with the plunger for moving the plunger inwardly in response to movement of the first end in the one direction, and the means for biasing the second piston includes the plunger and the rocker arm.

In one embodiment, the pump further comprises resilient means for pivotally mounting the rocker arm in the housing and for providing a seal between the rocker arm and the housing.

In one embodiment, the rocker arm includes means defining an annular groove extending around the rocker arm at the pivot point, and the resilient means includes an annular seal mounted in the housing and engaging the annular groove such that the rocker arm pivots about the seal.

In one embodiment, the second piston has a longitudinal axis extending in the direction of movement of the second piston, and the plunger has a longitudinal axis parallel to the longitudinal axis of the second piston and extending in the direction of movement of the plunger.

In one embodiment, the pump further comprises a fuel pumping chamber in the housing, and a fuel pumping piston reciprocally movable in the fuel pumping chamber to produce fuel flow in response to reciprocation of the fuel pumping piston in the fuel pumping chamber, and the oil outlet passageway communicates between the oil pumping chamber and the fuel pumping chamber.

In one embodiment, the pump further comprises a pressure actuated motor including a motor housing, a movable wall located in the motor housing and dividing the motor housing into high and low pressure chambers which inversely vary in volume relative to each other, means communicating with the chambers for causing reciprocation of the movable wall in response to cyclical pressure variations, means connecting the fuel pumping piston to the movable wall for common movement therewith, and means connecting the oil pumping piston to the movable wall for reciprocation in response to reciprocation of the movable wall.

In one embodiment, the means for causing reciprocation of the movable wall includes means for creating between the high and low pressure chambers a pressure differential having an amplitude, and the means connecting the oil pumping piston to the movable wall affords absence of reciprocation of the oil pumping piston when the pressure differential is below a given amplitude and affords increasing oil pumping piston reciprocation with increasing amplitude of the pressure differential above the given amplitude.

In one emoodiment, the means for causing reciprocation of the oil pumping piston is operable to provide common movement of the oil pumping piston with the movable wall during one portion of the reciprocation of the movable wall and is operable to provide lost motion between the movable wall and the oil pumping piston during another portion of the reciprocation of the movable wall.

The invention also provides an internal combustion engine comprising a crankcase subject to cyclical conditions of relatively high and low pressures, a pressure actuated motor including a motor housing, a movable wall located in the motor housing and dividing the motor housing into high and low pressure chambers which inversely vary in volume relative to each other, means for causing reciprocation of the movable wall and including means connecting the crankcase to the high and low pressure chambers so as to create therebetween a pressure differential, a fuel/oil pump including a pump housing, a fuel pumping chamber in the pump housing, a fuel pumping piston reciprocally movable in the fuel pumping chamber to produce fuel flow in response to reciprocation of the fuel pumping piston in the fuel pumping chamber, means connecting the fuel pumping piston to the movable wall for common movement therewith, an oil pumping chamber in the pump housing, an oil outlet passageway in the pump housing communicating with the oil pumping chamber, an oil pumping piston reciprocally movable in the oil pumping chamber to produce oil flow into the oil passageway in response to reciprocation of the oil pumping piston, means connecting the oil pumping piston to the movable wall for causing reciprocation of the oil pumping piston in response to reciprocation of the movable wall, a switch mounted on the pump housing and adapted to be operably connected to a device for actuation thereof, a second piston reciprocally movable in the housing relative to the oil outlet passageway between spaced first and second positions, means for closing the switch in response to movement of the second piston to the first position, and means biasing the second piston to tne second position.

The invention also provides an oil pressure sensitive switch assembly comprising a housing, a switch mounted on the housing and adapted to be operably connected to a device for actuation thereof, a rocker arm having opposite first and second ends and being pivotally mounted in the housing for movement about a pivot point intermediate the opposite ends, the second end being engageable with the switch for closing the switch in response to movement of the first end in one direction, and means for moving the first end of the rocker arm in the one direction in response to an oil pressure pulse.

Otner features and advantages of the invention will become apparent to those skilled in the art upon review of the following detailed description, claims, and drawings.

DESCRIPTION OF THE DRAWINGS

FIG. 1 includes a vertical cross-sectional view of a fuel/oil pump embodying the invention.

Figure 1:
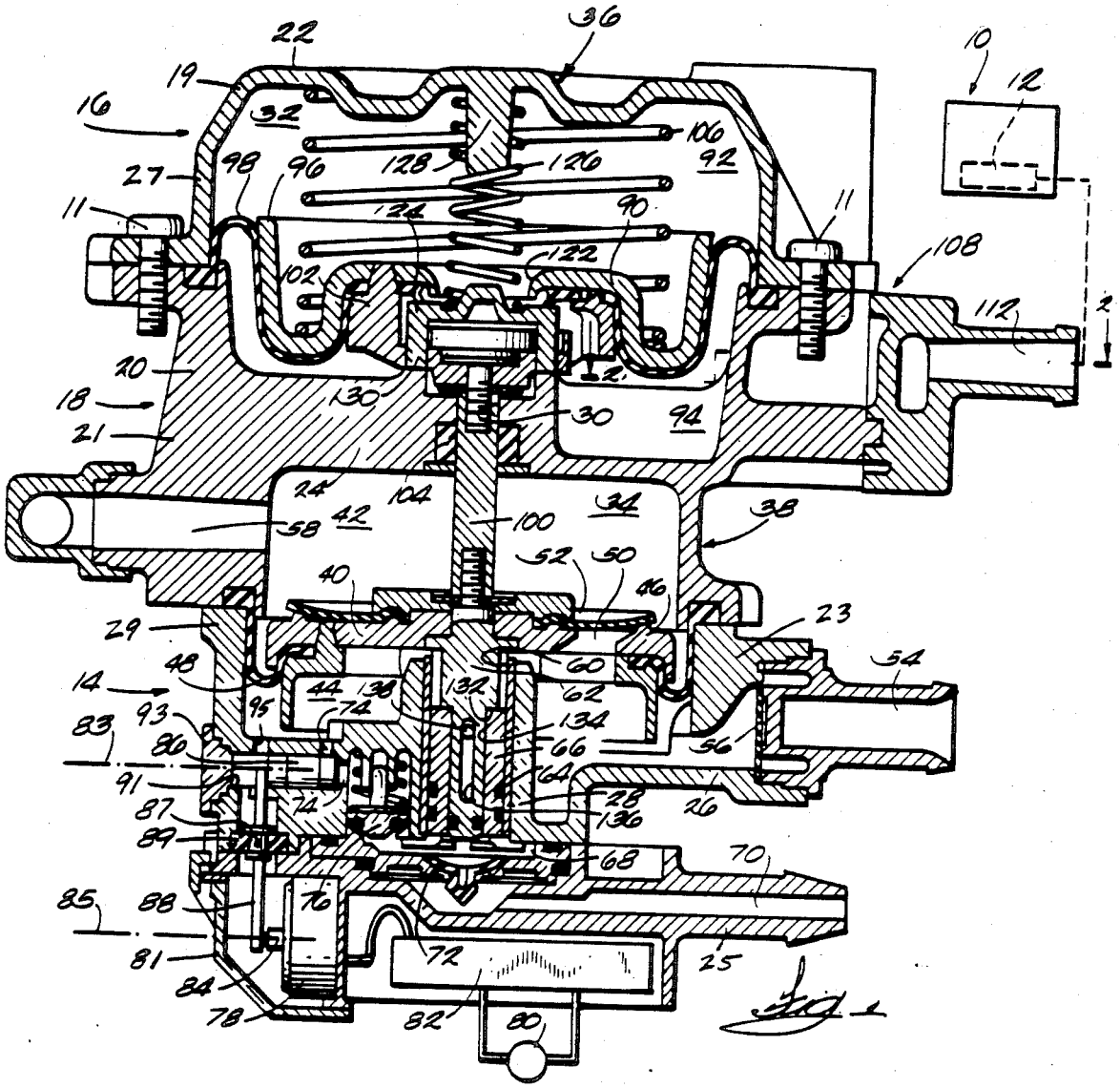
FIG. 1 is a schematic view of an internal combustion engine embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Shown in the drawings is an internal combustion engine 10 comprising a crankcase 12 (shown schematically), and a combined fuel/oil pump 14 and fluid pressure motor 16, the motor 16 being actuated by a source of alternating relatively high and low pressures. In the preferred embodiment, the source of alternating pressures is the crankcase 12.

More particularly, the combined motor and pump comprises a housing 18 which includes an upper housing portion 19, an upper middle housing portion 21, a lower middle housing portion 23, and a lower housing portion 25. The upper housing portion 19 includes a peripheral wall 27 and a top wall 22, the upper middle housing portion 21 includes a peripheral wall 20 and an intermediate wall or partition 24, and the lower middle housing portion 23 includes a peripheral wall 29, a bottom wall 26, and an inward extension 28. Any suitable means such as screws 11 can be used to retain the housing portions, 19, 21, 23 and 25 in assembled relation.

The intermediate wall 24 includes a central bore 30 and divides the housing 18 into an upper compartment 32 and a lower compartment or fuel pumping chamber 34. The walls 20, 22, 24, and 27 form a motor housing 36 defining the upper compartment 32, and the walls 20, 24, 26, and 29 form a pump housing 38 defining the lower compartment 34.

The pump 14 includes the pump housing 38, and a movable wall or member 40 which is located in the lower compartment 34 and which divides the lower compartment 34 into a variable volume upper chamber 42 located between the intermediate wall 24 and the movable wall or member 40 and a lower chamber 44 located between the bottom wall 26 and the member 40. The movable wall or member 40 includes a fuel pumping piston 46 which, at its periphery, has attached thereto a flexible membrane or diaphragm 48 which, in turn, is secured between the peripheral walls 29 and 20 of the housing 18.

The fuel pumping piston 46 is provided with one or more apertures 50, and a one-way check valve member 52 affording flow from the lower chamber 44 to the upper chamber 42 and preventing flow from the upper chamber 42 to the lower chamber 44.

The pump 14 also includes a valved fuel inlet 54 which is adapted to communicate with a suitable source of fuel (not shown) and which communicates with the lower chamber 44. The inlet 54 is located in the lower middle housing portion 23 and includes one-way check valve means 56 affording inflow of fuel in response to an increase in the volume of the lower chamber 44 and which prevents outflow of fuel from the lower chamber 44.

The pump 14 also includes, in the upper middle housing portion 21, an outlet 58 which communicates with the upper chamber 42 and which is adapted to communicate with a device, such as a carburetor, for feeding a fuel/oil mixture to the crankcase 12.

The pump 14 also includes a cylindrical space 60 which extends within the lower chamber 44 in the extension 28 and which is in generally aligned relation to the central bore 30 in the intermediate wall 24. Located in the cylindrical space 60 is an oil pumping plunger or element 62 which preferably extends integrally from the fuel pumping piston 46, and which is reciprocal in the cylindrical space 60. The pump 14 also includes an oil pumping piston 66 which partially defines a variable volume oil pumping chamber 68. The oil pumping chamber 68 is further defined by the lower housing portion 25. Seal means 64 is provided between the oil pumping piston 66 and the wall of the cylindrical space 60. The oil pumping piston 66 is engaged by the oil pumping plunger 62 in a manner described hereinafter.

The pump 14 also includes a valved inlet 70 which is adapted to communicate with a source of oil (not shown) and which communicates with the oil pumping chamber 68. The inlet 70 is located in the lower housing portion 25 and includes one-way check valve means 72 which affords oil flow into the oil pumping chamber 68 in response to an increase in the volume of the oil pumping chamber 68 and which prevents outflow of oil.

The pump 14 also includes an oil outlet passageway 74 communicating with the oil pumping chamber 68. In the preferred embodiment, the oil outlet passageway 74 is located in the lower middle housing portion 23 and communicates between the oil pumping chamber 68 and the lower chamber 44 of the fuel pumping chamber 34. However, it should be understood that in alternative embodiments the oil outlet passageway 74 need not communicate with the lower chamber 44. See, for example, the arrangements shown in U.S. Walsworth patent application Ser. No. 410,497, filed Aug. 23, 1982, and titled "Combined Fluid Pressure Actuated Fuel and Oil Pump," which is incorporated herein by reference. The pump 14 also includes one-way check valve means 76 which affords oil flow out of the oil pumping chamber 68 through the oil outlet passageway 74 in response to a decrease in volume of the oil pumping chamber 68 and which prevents oil flow into the oil pumping chamber 68 through the oil outlet passageway 74.

The pump 14 further includes a switch 78 mounted on the housing 18 and operably connected to a device 80 (shown schematically) for actuation thereof. In the preferred embodiment, the switch 78 is mounted on the lower housing portion 25 and is protected by a cover 81 attached to the lower housing portion 25. Preferably, the device 80 is a warning horn. In an alternative embodiment, the device 80 can be a warning light or other suitable alarm indicator. A circuit 82 connecting tne switch 78 to the device 80 is shown schematically in FIG. 1. Preferably, the circuit 82 monitors oil pulses or pressure spikes in the oil outlet passageway 74 by monitoring the closing of the switch 78 and actuates the device 80 when the rate of oil flow is too low. For an example of such a circuit, see U.S. patent No. 4,369,743, Holt, which is incorporated herein by reference.

In the preferred embodiment, the pump 14 further includes a second or switch piston 86 reciprocally movable in the lower middle housing portion 23 of the housing 18 along a generally horizontal longitudinal axis 83. In the illustrated construction, the switch piston 86 is movable within a cylindrical bore 91 in the lower middle housing portion 23. The fit between the switch piston 86 and the cylindrical bore 91 is loose enough so that a small amount of oil can flow around the switch piston 86, but tight enough so that the switch piston 86 is sensitive to oil pulses in the oil outlet passageway 74. The left end (as viewed in FIG. 1) of the cylindrical bore 91 is sealed by a plug 93 and communicates with the lower chamber 44 of the fuel pumping chamber 34 through an opening 95. Thus, the left end of the cylindrical bore 91 is filled with a fuel/oil mixture.

Figure 3:
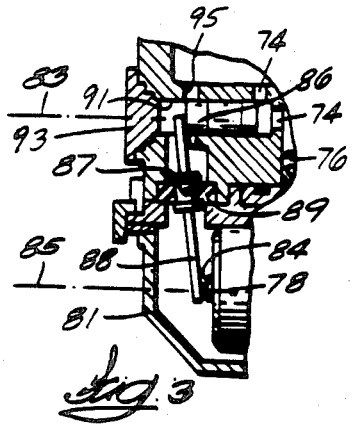
FIG. 3 is a partial cross-sectional view of the fuel/oil pump of FIG. 1.

The switch piston 86 is movable relative to the oil outlet passageway 74 between spaced first and second or left and right positions (as viewed in FIG. 1). The switch piston 86 is shown in the right position in FIG. 1, and in the left position in FIG. 3. In the preferred embodiment, movement of the switch piston 86 to the first or left position (FIG. 3) opens the oil outlet passageway 74, and movement of the switch piston 86 to the second or right position (FIG. 1) closes the oil outlet passageway 74. As best shown in FIG. 1, the oil outlet passageway 74 turns at a 90° angle (from horizontal to vertical) at the point at which the switch piston 86 is movable into the oil outlet passageway 74. The face or right end of the switch piston 86 faces the downstream horizontal portion of the oil outlet passageway 74. The upstream or vertical portion of the oil outlet passageway 74 is blocked by the switch piston 86 when the switch piston 86 is in the right position and is opened to the downstream portion of the oil outlet passageway 74 when the switch piston 86 is in the left position. Thus, the switch piston 86 acts as a check valve, opening the oil outlet passageway 74 only in response to an oil pulse or pressure spike in the downstream horizontal portion of the oil outlet passageway 74.

The pump 14 further includes means for closing the switch 78 in response to movement of the switch piston 86 to the first or left position, and means biasing the switch piston 86 to the second or right position. Preferably, the switch 78 includes an outwardly biased plunger 84 movable inwardly to close the switch 78, the plunger 84 having a generally horizontal longitudinal axis 85 parallel to the longitudinal axis 83 of the switch piston 86 and extending in the direction of movement of the plunger 84. The means for closing the switch 78 in response to movement of the switch piston 86 preferably includes a rocker arm 88 having opposite first and second or upper and lower ends and being pivotally mounted in the housing 18 for movement about a pivot point 87 intermediate the opposite ends. The upper end of the rocker arm 88 extends into the cylindrical bore 91 and is engageable with the switch piston 86 for movement in one direction (to the left in FIG. 1) in response to movement of the switch piston 86 to the left position (FIG. 3), and the lower end of the rocker arm 88 is engageable with the plunger 84 of the switch 78 for moving the plunger 84 inwardly in response to movement of the upper end of the rocker arm 88 to the left. In the preferred embodiment, the means for biasing the switch piston 86 to the right includes the outwardly biased plunger 84 and the rocker arm 88.

In the preferred embodiment, the pump 14 further includes resilient means for pivotally mounting the rocker arm 88 in the housing 18 and for providing a seal between the rocker arm 88 and the housing. While various suitable resilient means can be employed, in the illustrated construction, the rocker arm 88 includes means defining an annular groove extending around the rocker arm 88 at the pivot point 87, and the resilient means includes an annular seal 89 mounted in the housing 18 and engaging the annular groove such that the rocker arm 88 pivots about the seal 89. In the preferred embodiment, the seal 89 is mounted or captured between the lower housing portion 25 and the lower middle housing portion 23, and the seal 89 prevents the fuel/oil mixture in the left end of the cylindrical bore 91 from leaking out of the lower middle housing portion 23 into the switch cover 81. The seal 89 also biases the rocker arm 88 toward the vertical position (as viewed in FIG. 1) so as to bias the switch piston 86 to the right.

Thus, in operation, oil flows out of the oil pumping chamber 68 and into the oil outlet passageway 74 past the one-way check valve 76 in response to a decrease in volume of the oil pumping chamber 68 due to downward movement of the oil pumping piston 66. Actually, this oil flow is in the form of pulses having a frequency equal to the frequency of reciprocation of the oil pumping piston 66. This oil flow in the oil outlet passageway 74 (actually each pulse) causes the switch piston 86 to move to the left as oil flows out of the oil outlet passageway 74 into the lower chamber 44. Movement of the switch piston 86 to the left causes the rocker arm 88 to pivot counterclockwise as viewed in FIG. 1, thereby closing the switch 78.

The pressure actuated motor 16 is connected to the oil pumping plunger 62 and to the fuel pumping piston 46 so as to effect common reciprocation thereof through a given stroke or distance. As mentioned above, the pressure actuated motor 16 is responsive to a source of alternating relatively high and low pressures for effecting reciprocation of the fuel pumping piston 46 and the oil pumping plunger or element 62. The pressure actuated motor 16 includes a movable wall 90 which divides the upper compartment 32 into an upper, relatively low pressure variable volume chamber 92 and a lower, relatively high pressure variable volume chamber 94. The movable wall 90 includes a central or motor piston 96 which, at its outer periphery, is connected to a flexible membrane or diaphragm 98 which, at its outer periphery, is secured between the upper housing portion 19 and the upper middle housing portion 21 so as to divide the upper compartment 32 into the before-mentioned relatively low and high pressure chambers 92 and 94.

The central motor piston 96 is also preferably integrally connected with the fuel pumping piston 46 and with the oil pumping plunger or element 62 to form a unitary member 100. In this last regard, the member 100 extends from the fuel pumping piston 46 toward the motor piston 96 and through the central bore 30 in the intermediate wall 24, and the member 100 includes a connecting portion which forms an open valve cage 102 connected to the motor piston 96. A suitable seal 104 is provided between the intermediate wall 24 and the member 100.

The pressure actuated motor 16 further includes means biasing the movable wall 90 so as to displace the movable wall 90 in the direction minimizing the volume of the high pressure chamber 94 and maximizing the volume of the low pressure chamber 92. In the illustrated construction, such means comprises a helical spring 106 which, at one end, bears against the upper or top housing wall 22 and which, at the other end, bears against the motor piston 96.

The pressure actuated motor 16 also includes means 108 for creating a pressure differential between the low and high pressure chambers 92 and 94, respectively, so as to displace the movable wall 90 in the direction minimizing the volume of the low pressure chamber 92 and maximizing the volume of the high pressure chamber 94. While various arrangements can be employed, in the illustrated construction, the means 108 includes means adapted to be connected to a source of alternating relatively high and low pressures, preferably the crankcase 12, and including means permitting flow from the low pressure chamber 92 and preventing flow to the low pressure chamber 92, and means permitting flow to the high pressure chamber 94 and preventing flow from the high pressure chamber 94.

While the preferred source of alternating relatively high and low pressures is the crankcase 12, other sources of relatively high and low pressures can be employed. In addition, relatively high and low pressure can refer to two positive pressures above atmospheric pressure, to two negative pressures below atmospheric pressure, or to one positive pressure above atmospheric pressure and one negative pressure below atmospheric pressure.

Figure 2:
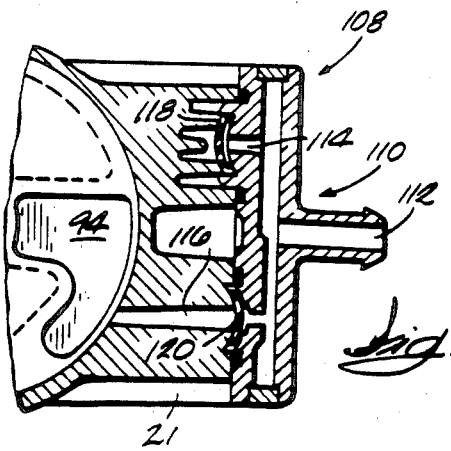
FIG. 2 is a cross-sectional view taken along line 2—2 in FIG. 1.

More particularly, the means 108 for creating the pressure differential between the relatively low and high pressure cylinders 92 and 94, respectively, includes a conduit system 110 (see FIG. 2) including a main conduit 112 adapted to be connected to the crankcase 12, together with a first or low pressure branch conduit 114 which communicates between the low pressure chamber 92 and the main conduit 112 and a second or high pressure branch conduit 116 which communicates between the high pressure chamber 94 and main conduit 112.

Included in the low pressure branch conduit 114 is a one-way check valve 118 which permits flow from the low pressure chamber 92 and prevents flow to the low pressure chamber 92. Located in the high pressure branch conduit 116 is a one way check valve 120 which permits flow to the high pressure chamber 94 and which prevents flow from the high pressure chamber 94.

Accordingly, alternating pressure pulses of relatively high and low pressures present in the main conduit 112 will cause the existence of a relatively high pressure in the high pressure chamber 94 and a relatively low pressure in the low pressure chamber 92, which pressure differential is of sufficient magnitude, as compared to the biasing action of the movable wall biasing spring 106, to cause movement of the movable wall 90 from a position in which the high pressure chamber 94 is at a minimum volume to a position in which the low pressure chamber 92 is at a minimum volume.

The pressure actuated motor 16 also includes means responsive to piston movement minimizing the volume of the low pressure chamber 92 for establishing communication between the low and high pressure chambers 92 and 94, respectively, so as thereby to reduce or minimize the pressure differential between the low an high pressure cnambers 92 and 94, respectively, and thereby to permit displacement of the movable wall 90 by the biasing spring 106 in the direction minimizing the volume of the high pressure chamber 94 and maximizing the volume of the low pressure chamber 92. While such means can be provided, at least in part, by a conduit (not shown) bypassing the motor piston 96, in the illustrated construction, such means comprises a central port 122 in the motor piston 96, together with a valve member 124 which is located in the open cage 102 and which is movable between a closed or upper and an open or lower position.

In addition, the means for effecting communication between the low and high pressure chambers 92 and 94, respectively, includes a helical valve member biasing spring 126 which urges the valve member 124 to the open position and which, at one end, bears against the upper or top wall 22 of the housing 18 and which, at the other end, extends through the port 122 in the motor piston 96 and bears against the upper surface of the valve member 124. The valve member biasing spring 126 is designed so as to be operable to overcome the pressure differential between the low and high pressure chambers 92 and 94, respectively, and thereby to displace the valve member as the motor piston 96 approaches the position minimizing the volume of the low pressure chamber 92.

Preferably, the valve biasing spring 126 has a spring rate which serves to open the port 122 prior to the full stroke of the motor piston 96 when the engine is operating at low speed and which serves to open the port 122 upon completion of the full stroke of the motor piston 96 when the engine is operating at high speed.

More particularly, in a two-stroke engine, movement of the piston relative to the cylinder and crankcase serves to produce in the crankcase cyclical conditions of relatively high and low pressures defining a crankcase pressure amplitude which varies in accordance with engine speed, i.e., which increases with engine speed. As, for example, when engine operation is at idle or low speed, the pressures in the crankcase can vary from about +3 psi to about −3 psi, thus providing a crankcase pressure amplitude of 6 psi. Also, for example, when operating at high engine speed, the pressure in the crankcase can vary from about +5 psi to −6 psi, or from about +10 psi to about −1 psi, thus providing a crankcase pressure amplitude of 11 psi.

Under operating conditions, because of the connection of the crankcase to the low and high pressure chambers 92 and 94, respectively, and the one-way check valves 118 and 120, the pressure conditions in the low and high pressure chambers 92 and 94, respectively, rapidly reflect the pressures in the crankcase 12 and provide a pressure differential across the movable motor piston 96, i.e., between the low and high pressure chambers 92 and 94, respectively, which pressure differential has an amplitude approximating the crankcase pressure amplitude.

Thus, partial movement of the motor piston 96 between the positions causing minimum volume of the low and high pressure chambers 92 and 94, respectively, will cause such contraction of the valve biasing spring 126 as to overcome the force on the valve member 124 occurring in response to the pressure differential when the engine 10 is operating at low speed. However, whenever the engine 10 operates at high speed, the force created by the pressure differential is sufficiently great to provide greater travel or full travel of the movable wall 90 or motor piston 96 prior to opening of the port 122. As a consequence, the motor piston 96 is provided with a stroke which varies with engine speed, i.e., is provided with a stroke which increases in length with engine speed.

Additionally, there is provided a member or post 128 which fixedly depends downwardly from the top housing wall 22 in position for engaging the valve member 124 as the movable wall 90 moves upwardly to minimize the volume of the low pressure chamber 92. Such engagement causes "cracking" or slight opening of the port 122, thereby somewhat diminishing the pressure differential across the movable wall 90. Such diminishment of the pressure differential facilitates immediately subsequent operation of the valve member biasing spring 126 to displace the valve member 124 so as to fully open the port 122 and thereby to substantially eliminate the pressure differential and obtain wall movement in the direction minimizing the volume of the high pressure chamber 94 under the action of the movable wall biasing spring 106. It is also noted that the post 128 serves to stabilize or locate the upper end of the valve member biasing spring 126.

The pressure actuated motor 16 also includes means responsive to piston movement minimizing the volume of the high pressure chamber 94 for discontinuing communication between the low and high pressure chambers 92 and 94, respectively, so as to thereby permit the creation of fluid pressure differential between the low and high pressure chambers 92 and 94 by the pressure differential creating means and thereby also to effect displacement of the motor piston 96 in the direction minimizing the volume of the low pressure chamber 92 and maximizing the volume of the high pressure chamber 94. While other arrangements can be employed, in the illustrated construction, such means comprises a plurality of studs or posts 130 which extend downwardly from the valve member 124 and througn the open valve cage 102 toward the intermediate wall 24 for engagement with the wall 24 to seat the valve member 124 in the closed position as the motor piston 96 approaches the position minimizing the volume of the high pressure chamber 94.

Thus, in operation, the presence of alternating high and low pressures in the conduit system 110 causes (assuming the valve member 124 to be in the closed position) buildup and maintenance of higher pressure in the relatively high pressure chamber 94 and reduction and maintenance of low pressure in the low pressure chamber 92. The pressure differential thus created causes displacement of the movable wall 90, including the motor piston 96, against the action of the motor piston biasing spring 106, to the position minimizing the volume of the low pressure chamber 92. As the motor piston 96 approaches the position minimizing the volume of the low pressure chamber 92, the valve member biasing spring 126 serves to open the motor piston port 122 by displacing the valve member 124 to the open position and thereby to reduce or minimize the pressure differential and permit displacement of the movable wall 90 by action of the biasing spring 106 to the position minimizing the volume of the high pressure chamber 94. During such movement, and in the absence of a pressure differential, the valve member 124 remains in the open position under the action of the valve member biasing spring 126.

Upon approach of the movable wall 90, including the motor piston 96, to the position minimizing the volume of the high pressure chamber 94, the studs 130 engage the wall 24 to cause movement of the valve member 124 to the closed position. With the motor piston port 122 thus closed, the pressure differential is again created and the movable wall 90 is again displaced in the opposite direction to commence another cycle of operation. As the fuel pumping piston 46 has common movement with the motor piston 96, the pressure actuated motor 16 causes reciprocation of the fuel pumping piston 46 at a frequency less than the frequency exciting the motor 16, i.e., less than the rate of alternation of the high and low pressures in the crankcase 12. Also, the amount of fuel pumped will vary in accordance with engine speed, i.e., will increase with increasing engine speed.

In the preferred embodiment, lost-motion means is provided for automatically varying the amount of oil pumped so that oil pumping does not occur until after a first engine speed level, which can be intermediate the low and high engine speeds, and so that, above the first engine speed level, oil pumping increases with increasing engine speed.

Accordingly, the oil pumping piston 66 is connected to the motor piston 96 to provide for common movement therewith during a portion of the motor piston stroke and to provide for lost motion during another portion of the motor piston stroke.

In the preferred embodiment, the lower end of the oil pumping element 62 has a diameter less than the diameter of the remainder of the oil pumping element 62 and forms a shoulder 132 which is engageable with the upper end of the oil pumping piston, and the oil pumping piston 66 has a cylindrical, axial bore 134 which slidably receives the lower end of the oil pumping element 62. Also, the lower end of the oil pumping element 62 includes an axially extending slot 136, and the oil pumping piston 66 includes a pin 138 extending through the axial bore 134 and being slidably received in the slot 136. As can be seen from viewing FIG. 1, engagement of the pin 138 with the lower end of the slot 136 limits upward movement of the oil pumping element 62 relative to the oil pumping piston 66.

Thus, with the oil pumping element 62 in the position shown in FIG. 1, the initial upstroke of the motor piston 96 from the position minimizing the volume of the high pressure chamber 94 does not cause accompanying movement of the oil pumping piston 6. However, before the motor piston 96 reaches the position minimizing the volume of the low pressure chamber 92, the pin 138 engages the lower end of the slot 136.to cause common movement of the oil pumping piston 66 with the motor piston 96. The initial downstroke of the motor piston 96 causes only limited oil pumping piston movement. More substantial oil pumping occurs after the shoulder 132 engages the upper end of the oil pumping piston 66. Thus, limited oil pumping operation occurs only at the top of the upstroke of the motor piston 96 and at the bottom of the downstoke of the motor piston 96. Accordingly, the pump 14 provides little pumping at low engine speeds and increased oil pumping with increasing speeds above low engine speed.

The combined pump and motor device can be mounted directly to the engine 10 so as to afford immediate connection to the crankcase 12 and can be connected to remote sources of oil and fuel. Alternately, if desired, the combined device can be located at a remote location more or less adjacent to or with the sources of fuel and oil and a conduit (not shown) can extend between the crankcase 12, or other source of alternating high and low pressures, and the combined device.

Various features and advantages of the invention are set forth in the following claims.

I claim:

1. A pump comprising a housing, an oil pumping chamber in said housing, an oil outlet passageway in said housing communicating with said oil pumping chamber, an oil pumping piston reciprocally movable in said oil pumping chamber to produce oil flow into said oil outlet passageway in response to reciprocation of said oil pumping piston, a switch mounted on said housing and adapted to be operably connected to a device for actuation thereof, a second piston reciprocally movable in said housing relative to said oil outlet passageway between spaced first and second positions, means biasing said second piston to said second position, and means for closing said switch in response to movement of said second piston to said first position, said means for closing said switch including a rocker arm having opposite first and second ends and being pivotally mounted in said housing for movement about a pivot point intermediate said opposite ends, said first end being engageable with said second piston for movement in one direction in response to movement of said second piston to said first position, and said second end being engageable with said switch for closing said switch in response to movement of said first end in said one direction.

2. A pump as set forth in claim 1 wherein said second piston moves to said first position in response to an oil pulse in said oil outlet passageway, wherein movement of said second piston to said first position opens said oil outlet passageway, and wherein movement of said second piston to said second position closes said oil outlet passageway.

3. A pump as set forth in claim 1 wherein said switch includes an outwardly biased plunger movable inwardly to close said switch, wherein said second end of said rocker arm is engageable with said plunger for moving said plunger inwardly in response to movement of said first end in said one direction, and wherein said means for biasing said second piston includes said plunger and said rocker arm.

4. A pump as set forth in claim 3 wherein said second piston has a longitudinal axis extending in the direction of movement of said second piston, and wherein said plunger has a longitudinal axis parallel to said longitudinal axis of said second piston and extending in the direction of movement of said plunger.

5. A pump as set forth in claim 1 and further comprising resilient means for pivotally mounting said rocker arm in said housing and for providing a seal between said rocker arm and said housing.

6. A pump as set forth in claim 5 wherein said rocker arm includes means defining an annular groove extending around said rocker arm at said pivot point, and wherein said resilient means includes an annular seal mounted in said housing and engaging said annular groove such that said rocker arm pivots about said seal.

7. A pump as set forth in claim 1 and further comprising a fuel pumping chamber in said housing, and a fuel pumping piston reciprocally movable in said fuel pumping chamber to produce fuel flow in response to reciprocation of said fuel pumping piston in said fuel pumping chamber, and wherein said oil outlet passageway communicates between said oil pumping chamber and said fuel pumping chamber.

8. A pump as set forth in claim 7 and further comprising a pressure actuated motor including a motor housing, a movable wall located in said motor housing and dividing said motor housing into high and low pressure chambers which inversely vary in volume relative to each other, means communicating with said chambers for causing reciprocation of said movable wall in response to cyclical pressure variations, means connecting said fuel pumping piston to said movable wall for common movement therewith, and means connecting said oil pumping piston to said movable wall for reciprocation in response to reciprocation of said movable wall.

9. A pump as set forth in claim 8 wherein said means for causing reciprocation of said movable wall includes means for creating between said high and low pressure chambers a pressure differential having an amplitude, and wherein said means connecting said oil pumping piston to said movable wall affords limited reciprocation of said oil pumping piston when said pressure differential is below a given amplitude and affords increasing oil pumping piston reciprocation with increasing amplitude of said pressure differential above said given amplitude.

10. A pump as set forth in claim 9 wherein said means for causing reciprocation of said oil pumping piston is operable to provide common movement of said oil pumping piston with said movable wall during one portion of the reciprocation of said movable wall and is operable to provide lost motion between said movable wall and said oil pumping piston during another portion of the reciprocation of said movable wall.

11. A pump comprising a housing, an oil pumping chamber in said housing, an oil outlet passageway in said housing communicating with said oil pumping chamber, an oil pumping piston reciprocally movable in said oil pumping chamber to produce oil flow into said oil outlet passageway in response to reciprocation of said oil pumping piston, a switch mounted on said housing and adapted to be operably connected to a device for actuation thereof, said switch including an outwardly biased plunger movable inwardly to close said switch, said plunger having a longitudinal axis parallel to said longitudinal axis of said second piston and extending in the direction of movement of said plunger, a second piston reciprocally movable in said housing relative to said oil outlet passageway between spaced first and second positions and having a longitudinal axis extending in the direction of movement of said second piston, said second piston moving to said first position to open said oil outlet passageway in response to an oil pulse in said oil outlet passageway, movement of said second piston to said second position closing said oil outlet passageway, a rocker arm including opposite first and second ends and means defining an annular groove extending around said rocker arm intermediate said opposite first and second ends, and resilient means for pivotally mounting said rocker arm in said housing and for providing a seal between said rocker arm and said housing, said resilient means including an annular seal mounted in said housing and engaging said annular groove such that said rocker arm pivots about said seal, said first end of said rocker arm being engageable with said second piston for movement in one direction in response to movement of said second piston to said first position, and said second end of said rocker arm being engageable with said plunger for moving said plunger inwardly to close said switch in response to movement of said first end in said one direction.

12. A pump as set forth in claim 11 wherein said housing includes a first portion having said second piston movable therein, and a second portion having said switch mounted thereon, and wherein said annular seal is mounted between said first and second housing portions.

13. An internal combustion engine comprising a fuel-/oil pump including a housing, a fuel pumping chamber in said housing, a fuel pumping piston reciprocally movable in said fuel pumping chamber to produce fuel flow in response to reciprocation of said fuel pumping piston in said fuel pumping chamber, an oil pumping chamber in said housing, an oil outlet passageway in said housing communicating with said oil pumping chamber, an oil pumping piston reciprocally movable in said oil pumping chamber to produce oil flow into said oil outlet passageway in response to reciprocation of said oil pumping piston, a switch mounted on said pump housing and adapted to be operably connected to a device for actuation thereof, a second piston reciprocally movable in said housing relative to said oil outlet passageway between spaced first and second positions, means biasing said second piston to said second position, and means for closing said switch in response to movement of said second piston to said first position, said means for closing said switch including a rocker arm having opposite first and second ends and being pivotally mounted in said housing for movement about a pivot point intermediate said opposite ends, said first end being engageable with said second piston for movement in one direction in response to movement of said second piston to said first position, and said second end being engageable with said switch for closing said switch in response to movement of said first end in said one direction.

14. An internal combustion engine as set forth in claim 13 wherein said second piston moves to said first position in response to an oil pulse in said oil outlet passageway, wherein movement of said second piston to said first position opens said oil outlet passageway, and wherein movement of said second piston to said second position closes said oil outlet passageway.

15. An internal combustion engine as set fortn in claim 13 wherein said switch includes an outwardly biased plunger movable inwardly to close said switch, wherein said second end of said rocker arm is engageable with said plunger for moving said plunger inwardly in response to movement of said first end in said one direction, and wherein said means for biasing said second piston includes said plunger and said rocker arm.

16. An internal combustion engine as set forth in claim 15 wherein said second piston has a longitudinal axis extending in the direction of movement of said second piston, and wherein said plunger has a longitudinal axis parallel to said longitudinal axis of said second piston and extending in the direction of movement of said plunger.

17. An internal combustion engine as set forth in claim 13 and further comprising resilient means for pivotally mounting said rocker arm in said housing and for providing a seal between said rocker arm and said housing.

18. An internal combustion engine as set forth in claim 17 wherein said rocker arm includes means defining an annular groove extending around said rocker arm at said pivot point, and wherein said resilient means includes an annular seal mounted in said housing and engaging said annular groove such that said rocker arm pivots about said seal.

19. An internal combustion engine as set forth in claim 13 and further comprising a pressure actuated motor including a motor housing, a movable wall located in said motor housing and dividing said motor housing into high and low pressure chambers which inversely vary in volume relative to each other, means communicating with said chambers for causing reciprocation of said movable wall in response to cyclical pressure variations, means connecting said fuel pumping piston to said movable wall for common movement therewith, and means connecting said oil pumping piston to said movable wall for reciprocation in response to reciprocation of said movable wall.

20. An internal combustion engine as set forth in claim 19 wherein said means for causing reciprocation of said movable wall includes means for creating between said high and low pressure chambers a pressure differential having an amplitude, and wherein said means connecting said oil pumping piston to said movable wall affords limited reciprocation of said oil pumping piston when said pressure differential is below a given amplitude and affords increasing oil pumping piston reciprocation with increasing amplitude of said pressure differential above said given amplitude.

21. An internal combustion engine as set forth in claim 20 wherein said means for causing reciprocation of said oil pumping piston is operable to provide common movement of said oil pumping piston with said movable wall during one portion of the reciprocation of said movable wall and is operable to provide lost motion between said movable wall and said oil pumping piston during another portion of the reciprocation of said movable wall.

22. An internal combustion engine comprising a crankcase subject to cyclical conditions of relatively high and low pressures, a pressure actuated motor including a motor housing, a movable wall located in said motor housing and dividing said motor housing into high and low pressure chambers which inversely vary in volume relative to each other, means for causing reciprocation of said movable wall and including means connecting said crankcase to said high and low pressure chambers so as to create therebetween a pressure differential, a fuel/oil pump including a pump housing, a fuel pumping chamber in said pump housing, a fuel pumping piston reciprocally movable in said fuel pumping chamber to produce fuel flow in response to reciprocation of said fuel pumping piston in said fuel pumping chamber, means connecting said fuel pumping piston to said movable wall for common movement therewith, an oil pumping chamber in said pump housing, an oil outlet passageway in said pump housing communicating with said oil pumping chamber, an oil pumping piston reciprocally movable in said oil pumping chamber to produce oil flow into said oil outlet passageway in response to reciprocation of said oil pumping piston, means connecting said oil pumping piston to said movable wall for causing reciprocation of said oil pumping piston in response to reciprocation of said movable wall, a switch mounted on said pump housing and adapted to be operably connected to a device for actuation thereof, a second piston reciprocally movable in said housing relative to said oil outlet passageway between spaced first and second positions, means biasing said second piston to said second position, and means for closing said switch in response to movement of said second piston to said first position, said means for closing said switch including a rocker arm having opposite first and second ends and being pivotally mounted in said housing for movement about a pivot point intermediate said opposite ends, said first end being engageable with said second piston for movement in one direction in response to movement of said second piston to said first position, and said second end being engageable with said switch for closing said switch in response to movement of said first end in said one direction.

23. An internal combustion engine as set forth in claim 22 wherein said second piston moves to said first position in response to an oil pulse in said oil outlet passageway, wherein movement of said second piston to said first position opens said oil outlet passageway, and wherein movement of said second piston to said second position closes said oil outlet passageway.

24. An internal combustion engine as set forth in claim 22 wherein said switch includes an outwardly biased plunger movable inwardly to close said switch, wherein said second end of said rocker arm is engageable with said plunger for moving said plunger inwardly in response to movement of said first end in said one direction, and wherein said means for biasing said second piston includes said plunger and said rocker arm.

25. An internal combustion engine as set forth in claim 24 wherein said second piston has a longitudinal axis extending in the direction of movement of said second piston, and wherein said plunger has a longitudinal axis parallel to said longitudinal axis of said second piston and extending in the direction of movement of said plunger.

26. An internal combustion engine as set forth in claim 22 wherein said pressure differential has an amplitude, and wherein said means connecting said oil piston to said movable wall affords limited reciprocation of said oil pumping piston when said pressure differential is below a given amplitude and affords increasing oil pumping piston reciprocation with increasing amplitude of said pressure differential above said given amplitude.

27. An internal combustion engine as set forth in claim 26 wherein said means for causing reciprocation of said oil pumping piston is operable to provide common movement of said oil pumping piston with said movable wall during one portion of the reciprocation of said movable wall and is operable to provide lost motion between said movable wall and said oil pumping piston during another portion of the reciprocation of said movable wall.

28. An internal combustion engine as set forth in claim 22 and further comprising resilient means for pivotally mounting said rocker arm in said housing and for providing a seal between said rocker arm and said housing.

29. An internal combustion engine as set forth in claim 28 wherein said rocker arm includes means defining an annular groove extending around said rocker arm at said pivot point, and wherein said resilient means includes an annular seal mounted in said housing and engaging said annular groove such that said rocker arm pivots about said seal.

30. An oil pressure sensitive switch assembly comprising a housing, a switch mounted on said housing and adapted to be operably connected to a device for actuation thereof, a rocker arm having opposite first and second ends and being pivotally mounted in said housing for movement about a pivot point intermediate said opposite ends, said second end being engageable with said switch for closing said switch in response to movement of said first end in one direction, and means for moving said first end of said rocker arm in said one direction by a force produced by an oil pressure pulse.

31. An assembly as set forth in claim 30, wherein said switch includes an outwardly biased plunger movable inwardly to close said switch, and wherein said second end of said rocker arm is engagable with said plunger for moving said plunger inwardly in response to movement of said first end in said one direction.

32. An assembly as set forth in claim 30 wherein said means for moving said first end of said rocker arm includes an oil passageway in said housing, and a piston reciprocally movable in said housing relative to said oil passageway between spaced first and second positions, wherein said piston moves to said first position in response to an oil pulse in said oil passageway, and wherein said first end of said rocker arm is engageable with said piston for movement in said one direction in response to movement of said piston to said first position.

33. An assembly as set forth in claim 30 and further comprising resilient means for pivotally mounting said rocker arm in said housing and for providing a seal between said rocker arm and said housing.

34. An assembly as set forth in claim 33 wherein said rocker arm includes means defining an annular groove extending around said rocker arm at said pivot point, and wherein said resilient means includes an annular seal mounted in said housing and engaging said annular groove such that said rocker arm pivots about said seal.

35. An assembly as set forth in claim 34 wherein said housing includes a first portion having said first end of said rocker arm therein, and a second portion having said switch mounted thereon, and wherein said annular seal is mounted between said first and second housing portions.

* * * * *